US008834213B2

(12) United States Patent
Sato et al.

(10) Patent No.: US 8,834,213 B2
(45) Date of Patent: Sep. 16, 2014

(54) CONNECTION STRUCTURE OF CRIMPING TERMINAL TO ELECTRIC WIRE

(75) Inventors: Kei Sato, Makinohara (JP); Shinji Kodama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 22 days.

(21) Appl. No.: 13/583,458

(22) PCT Filed: Mar. 25, 2011

(86) PCT No.: PCT/JP2011/057449

§ 371 (c)(1),
(2), (4) Date: Sep. 7, 2012

(87) PCT Pub. No.: WO2011/125559

PCT Pub. Date: Oct. 13, 2011

(65) Prior Publication Data

US 2012/0329343 A1 Dec. 27, 2012

(30) Foreign Application Priority Data

Apr. 1, 2010 (JP) ..... 2010-085080

(51) Int. Cl.

| | |
|---|---|
| ***H01R 4/18*** | (2006.01) |
| ***H01R 13/52*** | (2006.01) |
| ***H01R 4/20*** | (2006.01) |
| *H01R 4/62* | (2006.01) |

(52) U.S. Cl.

CPC ..... *H01R 4/185* (2013.01); *H01R 13/52* (2013.01); *H01R 4/20* (2013.01); *H01R 4/62* (2013.01)

USPC ..... 439/866; 439/878

(58) Field of Classification Search

USPC ..... 439/866, 852, 878

See application file for complete search history.

(56) References Cited

U.S. PATENT DOCUMENTS

| | | | | |
|---|---|---|---|---|
| 7,115,004 | B2 * | 10/2006 | Takayama | 439/852 |
| 2001/0005647 | A1 | 6/2001 | Endo et al. | |

(Continued)

FOREIGN PATENT DOCUMENTS

| | | | |
|---|---|---|---|
| CN | 1653650 | A | 8/2005 |
| JP | 2000-251961 | A | 9/2000 |

(Continued)

OTHER PUBLICATIONS

International Search Report dated May 31, 2011 from the International Searching Authority in counterpart international application No. PCT/JP2011/057449(060435).

(Continued)

*Primary Examiner* — Hae Moon Hyeon

(74) *Attorney, Agent, or Firm* — Sughrue Mion, PLLC

(57) ABSTRACT

In a structure in which a crimping terminal (10) in which an electric wire connection part (12) is formed in substantially a U shape in cross-section view by having base plate parts (21, 23) and pairs of electric wire crimping pieces (22, 24) is used and a metallic tubular cap (30) is attached to a conductor (Wa) exposed by removing a portion of an insulating sheath (Wb) of the distal end of an electric wire W and the electric wire crimping pieces (22, 24) are crimped while crushing the conductor (Wa) of the distal end of the electric wire W together with the cap (30) thereon, a front end (31) of the cap (30) is crushed and thereby the front end of the cap (30) is sealed with its crush part (35).

3 Claims, 7 Drawing Sheets

(56) References Cited

U.S. PATENT DOCUMENTS

| | | | | |
|---|---|---|---|---|
| 2005/0153605 | A1 | 7/2005 | Anbo et al. | |
| 2005/0227549 | A1 * | 10/2005 | Takayama | 439/851 |
| 2006/0205287 | A1 | 9/2006 | Takayama | |
| 2012/0329342 | A1 * | 12/2012 | Sato | 439/866 |
| 2013/0005197 | A1 * | 1/2013 | Sato | 439/741 |
| 2013/0130569 | A1 * | 5/2013 | Sato | 439/882 |

FOREIGN PATENT DOCUMENTS

| | | | | |
|---|---|---|---|---|
| JP | 200471437 | A | 3/2004 | |
| JP | 2004207172 | A * | 7/2004 | H01R 4/22 |
| JP | 2005302475 | A | 10/2005 | |
| JP | 2007311369 | A | 11/2007 | |
| JP | 2008226836 | A * | 9/2008 | |
| JP | 2009135105 | A | 6/2009 | |

OTHER PUBLICATIONS

Written Opinion dated May 31, 2011 from the International Searching Authority in counterpart international application No. PCT/JP2011/057449.

Office Action, dated for Dec. 25, 2013, issued by the Russian Patent Office in counterpart Russian Application No. 2012137277/07.

Communication dated Mar. 24, 2014 issued by the Japanese Patent Office in counterpart Japanese Patent Application No. 2010-085080.

Communication dated May 27, 2014 from the State Intellectual Property Office of P.R. China in a counterpart application No. 201180012055.9.

* cited by examiner

CONNECTION STRUCTURE OF CRIMPING TERMINAL TO ELECTRIC WIRE

BACKGROUND OF THE INVENTION

1. Field of the Invention

The present invention relates to a connection structure of a crimping terminal to an electric wire.

2. Description of Related Art

FIGS. 7(*a*) to 7(*c*) show a connection structure between a terminal and an electric wire described in Patent Reference 1.

In this connection structure between the terminal and the electric wire, as shown in FIGS. 7(*a*) and 7(*b*), a metallic cap 230 with the size in which the range from a conductor (mainly including a twisted wire obtained by twisting many strands together) Wa exposed by removing an insulating sheath Wb to the portion having the insulating sheath Wb is covered is first attached to the distal end of an electric wire W, and the insertion portion of the conductor Wa of the distal end of the electric wire W to which the cap 230 is attached is placed on a base plate part 221 of an electric wire connection part 212 formed in the back of a terminal 210. In that state, as shown in FIG. 7(*c*), a pair of conductor crimping pieces 222 extending in both lateral edges of the base plate part 221 is crimped so as to obtain a state in which the conductor Wa and the cap 230 make close contact with an upper surface of the base plate part 221 by inwardly bending the conductor crimping pieces 222 so as to wrap the cap 230.

The cap 230 has a bag shape in which the front end is closed and the back end is opened, and a portion 231 into which the outer periphery of the conductor Wa is fitted is formed in a tube shape with a small diameter, and an inlet (back end) side portion 232 into which the outer periphery of the insulating sheath Wb is fitted is formed in a tube shape with a large diameter, and a gap between the conductor Wa and the cap 230 is filled with a waterproof filler (not shown). Also, an inner peripheral surface of the electric wire connection part 212 of the terminal 210 is provided with serrations 228 for increasing contact continuity between the cap 230 and the terminal 210.

The reason why the cap 230 is used herein is because electrolytic corrosion may occur when water adheres to a part of contact between different kinds of metals (that is, a crimping part) in the case where, for example, the conductor Wa of the electric wire W is made of aluminum or aluminum alloy and the terminal 210 is made of copper or copper alloy, and a material of the cap 230 is set in the same kind (copper or copper alloy) as a material of the terminal 210. A terminal made of aluminum or aluminum alloy can also be used for an aluminum electric wire, but a terminal made of copper or copper alloy has an advantage over the terminal made of aluminum or aluminum alloy in strength. When the materials are selected thus, the cap 230 is made of metal different from that of the conductor Wa of the electric wire W (the former is made of copper or copper alloy and the latter is made of aluminum or aluminum alloy), but a gap between the conductor Wa and the cap 230 is filled with a filler (not shown), and water is prevented from entering the inside of the cap 230 and there is no fear of electrolytic corrosion.

SUMMARY OF THE INVENTION

In the conventional connection structure as described above, as the cap 230, a cap squeezed so as to close the front end or a cap cut so as to close the front end is normally used, but when such caps are used, their work methods are more sophisticated than normal press work and productivity is low, so that an increase in cost was caused.

The invention has been implemented in view of the circumstances described above, and an object of the invention is to provide a connection structure in which a crimping terminal is connected to an electric wire while using a lower-cost cap.

In order to achieve the object described above, a connection structure of a crimping terminal to an electric wire according to the invention is characterized by the following (1) to (3).

(1) A connection structure of a crimping terminal to an electric wire, the crimping terminal having an electric connection part for making connection to the other terminal in the front, and an electric wire connection part formed in substantially a U shape in cross-section view by having a base plate part, and a pair of electric wire crimping pieces which upwardly extends from both lateral edges of the base plate part and is crimped so as to obtain a state in which a distal end of the electric wire is brought into close contact with an upper surface of the base plate part by inwardly bending the electric wire crimping pieces so as to wrap the distal end of the electric wire to be connected in the back of the electric connection part, wherein a metallic tubular cap is attached to a conductor exposed by removing an insulating sheath of the distal end of the electric wire so as to cover a range to a portion of the insulating sheath of the electric wire, and the electric wire crimping pieces are crimped so as to surround the cap and also, a front end of the cap is crushed and thereby the front end of the cap is sealed with its crush part.

(2) In the connection structure of the crimping terminal to the electric wire with the configuration of the above (1), a corrosion-proofing agent is applied so as to cover a crush part of the cap.

(3) In the connection structure of the crimping terminal to the electric wire with the configuration of the above (1) or (2), the cap is formed of a metal of the same kind as that of the terminal.

According to the connection structure of the crimping terminal to the electric wire with the configuration of the above (1), the front end of the pipe-shaped cap into which the distal end of the electric wire is inserted is crushed and the front end of the cap is sealed with its crush part, so that while the tubular member, with a very simple shape, whose both ends are opened without the need for squeezing work, cutting work, etc. is used as a cap material, hermeticity to the distal end of the electric wire can be held and fear of electrolytic corrosion due to entrance of water from the outside can be solved. In this case, the front end of the cap can simultaneously be crushed with the press by a crimp metal mold when the electric wire crimping pieces are crimped, or the front end of the cap can be crushed with the press at the time when the distal end of the electric wire is inserted into the pipe-shaped cap, or the front end of the cap can be crushed with the press in the stage before the distal end of the electric wire is inserted into the pipe-shaped cap.

According to the connection structure of the crimping terminal to the electric wire with the configuration of the above (2), the corrosion-proofing agent is applied so as to cover the crush part of the cap, so that hermeticity to the distal end of the electric wire can be held more surely.

According to the connection structure of the crimping terminal to the electric wire with the configuration of the above (3), the cap is constructed of the metal of the same kind as that of the terminal, so that electrolytic corrosion does not occur even when water adheres to the part of contact between the cap and the terminal.

According to the invention, hermeticity to the distal end of the electric wire can be held while the tubular member, with the very simple shape, whose both ends are opened without the need for the squeezing work, the cutting work, etc. is used as the cap material. Therefore, an increase in cost can be avoided.

The invention has been described above briefly. Further, the details of the invention will become more apparent by reading through a mode for carrying out the invention described below with reference to the accompanying drawings.

DETAILED DESCRIPTION OF THE INVENTION

Each embodiment of the invention will hereinafter be described with reference to the drawings.

First Embodiment

Figure 1:
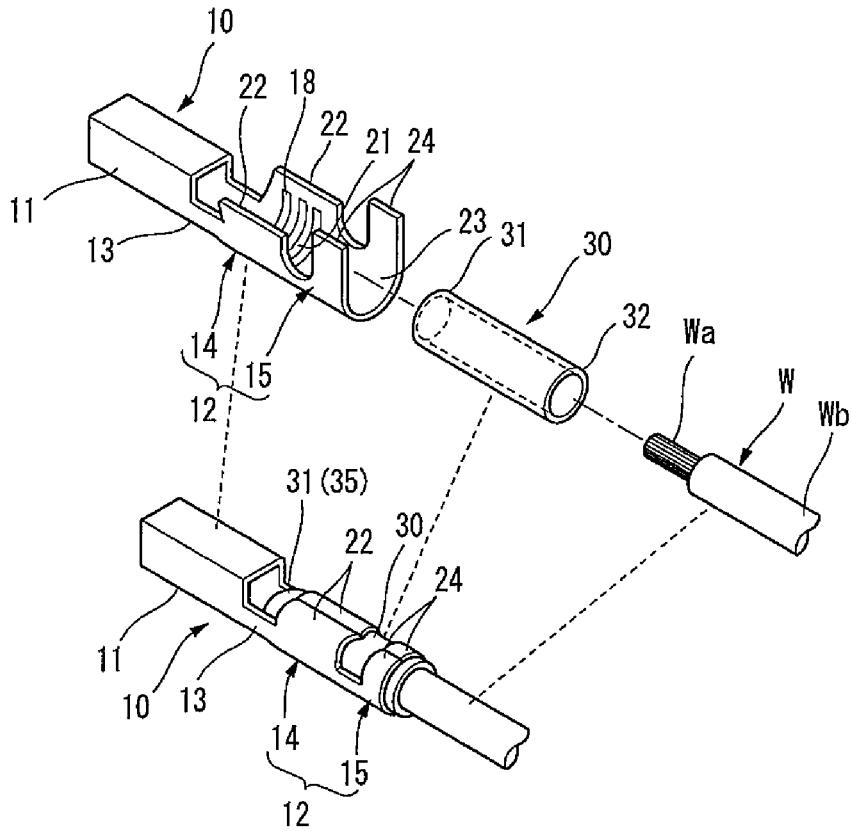
FIG. 1 is an explanatory diagram of a first embodiment of the invention, and is a completion perspective view and an exploded perspective view showing a relation among a crimping terminal, an electric wire and a cap.
Figure 2A:
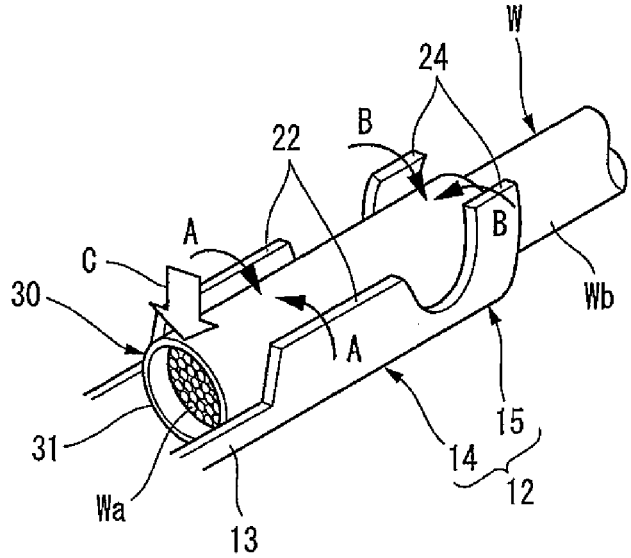
FIGS. 2(*a*) and 2(*b*) are step explanatory diagrams of the first embodiment, and FIG. 2(*a*) is a perspective view showing a state in which the tubular cap into which the distal end of the electric wire is inserted is set in an electric wire connection part of the crimping terminal, and FIG. 2(*b*) is a perspective view showing a state in which while crimping conductor crimping pieces and sheath crimping pieces of the electric wire connection part, the front end of the cap is crushed and an opening of the front end of the cap is sealed with its crush part.
Figure 2B:
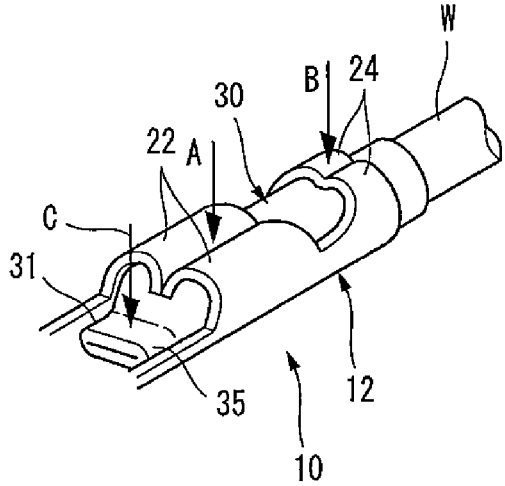
Figure 3A:
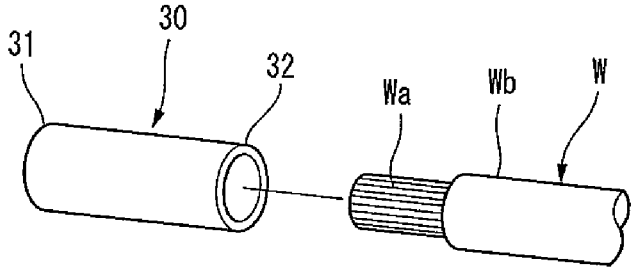
FIGS. 3(*a*) to 3(*d*) are step explanatory diagrams of a second embodiment of the invention, and FIG. 3(*a*) is a perspective view showing a state in which the distal end of an electric wire attempts to be inserted into a tubular cap whose both ends are opened, and FIG. 3(*b*) is an outline perspective view showing a state in which the distal end of the electric wire is inserted into the cap, and FIG. 3(*c*) is a sectional view of FIG. 3(*b*), and FIG. 3(*d*) is a sectional view showing a state in which the front end of the cap is then crushed and an opening of the front end of the cap is sealed with its crush part.
Figure 3B:
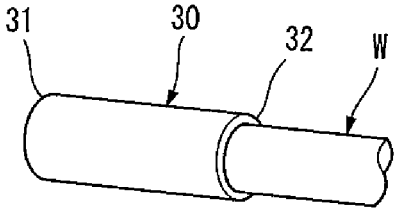
Figure 3C:
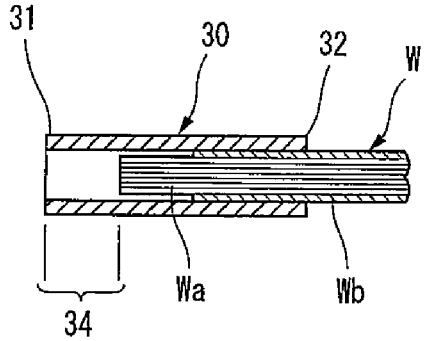
Figure 3D:
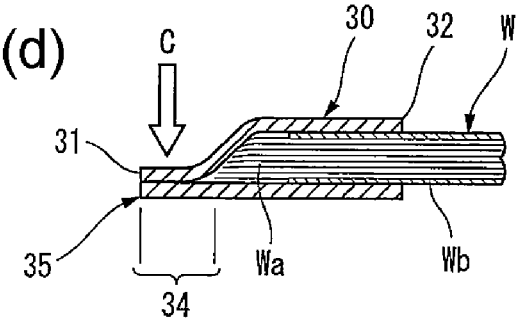
Figure 4A:
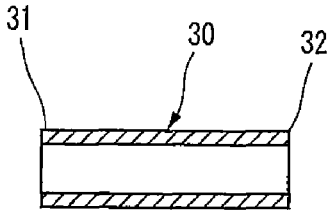
FIGS. 4(*a*) to 4(*d*) are step explanatory diagrams of a third embodiment of the invention, and FIG. 4(*a*) is a sectional view showing a tubular cap whose both ends are opened, and FIG. 4(*b*) is a sectional view showing a state in which the front end of the tubular cap is crushed and an opening of the front end of the cap is sealed with its crush part, and FIG. 4(*c*) is a sectional view showing a state in which the distal end of an electric wire attempts to be inserted into the cap whose front end is crushed, and FIG. 4(*d*) is a sectional view showing a state in which the distal end of the electric wire is inserted into the cap whose front end is crushed.
Figure 4B:
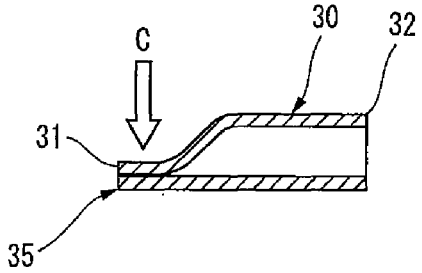
Figure 4C:
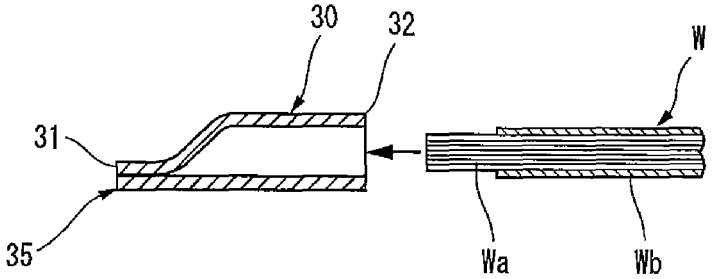
Figure 4D:
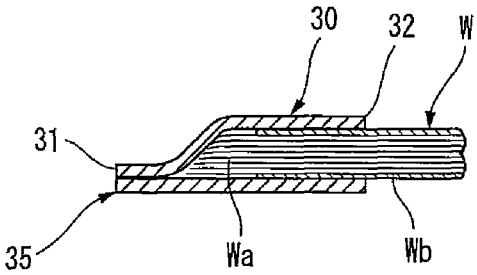

FIG. 1 is an explanatory diagram of a first embodiment and is a completion perspective view and an exploded perspective view showing a relation among a crimping terminal, an electric wire and a cap, and FIGS. 2(*a*) and 2(*b*) are step explanatory diagrams of the first embodiment, and FIG. 2(*a*) is a perspective view showing a state in which the tubular cap into which the distal end of the electric wire is inserted is set in an electric wire connection part of the crimping terminal, and FIG. 2(*b*) is a perspective view showing a state in which while crimping conductor crimping pieces and sheath crimping pieces of the electric wire connection part, the front end of the cap is crushed and an opening of the front end of the cap is sealed with its crush part.

As shown in FIG. 1, this crimping terminal 10 is a female terminal, and has a box-shaped electric connection part 11, with a built-in spring piece, for making connection to the other terminal etc. (not shown) in the front, and has an electric wire connection part 12 crimped and connected to the distal end of an electric wire W through a joining part 13 in the back of the electric connection part 11.

The electric wire connection part 12 includes a conductor crimping part 14 positioned in the front side, and a sheath crimping part 15 positioned in the back side of the conductor crimping part 14. The conductor crimping part 14 of the front side is formed in substantially a U shape in cross-section view by having a base plate part 21 and a pair of conductor crimping pieces (electric wire crimping pieces) 22 which upwardly extends from both lateral edges of the base plate part 21 and is crimped so as to obtain a state in which a conductor Wa is brought into close contact with an upper surface of the base plate part 21 by inwardly bending the conductor crimping pieces 22 so as to wrap the conductor Wa exposed by removing an insulating sheath (hereinafter also called a coating simply) Wb of the distal end of the electric wire W to be connected. Also, the sheath crimping part 15 of the back side is formed in substantially a U shape in cross-section view by having a base plate part 23 and a pair of sheath crimping pieces (electric wire crimping pieces) 24 which upwardly extends from both lateral edges of the base plate part 23 and is crimped so as to obtain a state in which the portion of the coating Wb of the distal end of the electric wire W is brought into close contact with an upper surface of the base plate part 23 by inwardly bending the sheath crimping pieces 24 so as to wrap the portion having the insulating sheath Wb of the distal end of the electric wire W to be connected.

Here, the base plate part 21 of the conductor crimping part 14 and the base plate part 23 of the sheath crimping part 15 are continuously formed as a common base plate part. Also, the conductor crimping pieces 22 of the conductor crimping part 14 and the sheath crimping pieces 24 of the sheath crimping part 15 are formed in the form in which the lower ends are somewhat continuously joined but the upper ends are mutually divided by U-shaped notches put in the boundary between both crimping pieces so as to be able to be crimped respectively independently. Also, an inner peripheral surface of the conductor crimping part 14 is provided with plural serrations (recessed grooves) 18 extending in a direction intersecting with a longitudinal direction of the electric wire W. In addition, an inner peripheral surface of the sheath crimping part 15 is provided with a serration or a protrusion extending in the direction intersecting with the longitudinal direction of the electric wire W as necessary.

A metallic tubular cap 30 is used for obtaining a connection structure of the embodiment. This cap 30 is formed of a metal (for example, copper or copper alloy) of the same kind as that of the crimping terminal 10, and is made of a circular tubular member in which both of the front end 31 and the back end 32 of a longitudinal direction are opened. The cap 30 has a length capable of covering the range from the front end of the conductor Wa in the distal end of the electric wire W to the portion having the insulating sheath Wb.

After the conductor Wa with a proper length is exposed to the distal end of the electric wire W by removing the insulating sheath Wb, the metallic cap 30 is attached to its distal end so as to cover the range from the conductor Wa to the portion having the coating Wb. In this case, the front end 31 of the cap 30 is provided with a crush margin (empty space into which the conductor Wa is not inserted) resulting in a crush part 35 afterward.

Next, the distal end of the electric wire W to which the cap 30 is attached is placed on upper surfaces of the base plate parts 21, 23 of the conductor crimping part 14 and the sheath crimping part 15 of the electric wire connection part 12 of the crimping terminal 10 as shown in FIG. 2(*a*). Here, the front end 31 of the cap 30 is positioned so as to protrude to the front side beyond the conductor crimping part 14. Then, the conductor crimping pieces 22 of the conductor crimping part 14 and the sheath crimping pieces 24 of the sheath crimping part 15 are inwardly bent and are crimped so as to surround the distal end of the electric wire W through the cap 30 and thereby, the cap 30 and the conductor Wa of the electric wire are crushed and deformed to obtain the connection structure of the embodiment in which the crimping terminal 10 is connected to the electric wire W as shown in FIG. 2(*b*). In that case, while crimping the conductor crimping pieces 22 and the sheath crimping pieces 24, the front end 31 of the cap 30 is crushed by a part of a crimp metal mold, and an opening of the front end 31 of the cap 30 is sealed with its crush part 35. In addition, arrows A and B in FIGS. 2(*a*) and 2(*b*) show crimp operations of the conductor crimping pieces 22 and the sheath crimping pieces 24, and an arrow C in FIGS. 2(*a*) and 2(*b*) shows a crush operation of the front end of the cap 30.

According to the connection structure of the crimping terminal 10 to the electric wire W configured thus, the front end 31 of the tubular cap 30 into which the distal end of the electric wire W is inserted is crushed and the front end 31 of the cap 30 is sealed with its crush part 35, so that while the tubular member whose both ends are opened without the need for squeezing work, cutting work, etc. is used as a cap material, hermeticity to the distal end of the electric wire W can be held and fear of electrolytic corrosion due to entrance of water from the outside can be solved. Therefore, cost can be made lower than a conventional connection structure using a cap manufactured by the squeezing work, the cutting work, etc. Also in this case, the front end 31 of the cap 30 is simultaneously crushed with the press by the crimp metal mold when the electric wire crimping pieces (the conductor crimping pieces 22 and the sheath crimping pieces 24) are crimped, so that extra work time and effort are not required.

Second Embodiment

FIGS. 3(*a*) to 3(*d*) are step explanatory diagrams of a second embodiment, and FIG. 3(*a*) is a perspective view showing a state in which the distal end of an electric wire attempts to be inserted into a tubular cap whose both ends are opened, and FIG. 3(*b*) is an outline perspective view showing a state in which the distal end of the electric wire is inserted into the cap, and FIG. 3(*c*) is a sectional view of the state of FIG. 3(*b*), and FIG. 3(*d*) is a sectional view showing a state in which the front end of the cap is then crushed and an opening of the front end of the cap is sealed with its crush part.

In this second embodiment, the distal end of an electric wire W is inserted into a tubular cap 30 whose both of the front end 31 and the back end 32 are opened, and a crush margin portion 34 (portion into which a conductor Wa of the electric wire W is not inserted) formed in the front end 31 of the cap 30 is crushed with the press in that state and an opening of the front end 31 of the cap 30 is sealed with its crush part 35 as shown in FIGS. 3(*a*) to 3(*d*). In addition, an arrow C in the drawing shows a crush operation of the front end 31 of the cap 30.

Third Embodiment

FIGS. 4(*a*) to 4(*d*) are step explanatory diagrams of a third embodiment, and FIG. 4(*a*) is a sectional view showing a tubular cap whose both ends are opened, and FIG. 4(*b*) is a sectional view showing a state in which the front end of the tubular cap is crushed and an opening of the front end of the cap is sealed with its crush part, and FIG. 4(*c*) is a sectional view showing a state in which the distal end of an electric wire attempts to be inserted into the cap whose front end is crushed, and FIG. 4(*d*) is a sectional view showing a state in which the distal end of the electric wire is inserted into the cap whose front end is crushed.

In this third embodiment, before the distal end of an electric wire W is inserted into a tubular cap 30 whose both of the front end 31 and the back end 32 are opened, the front end 31 of the cap 30 is previously crushed and an opening of the front end 31 of the cap 30 is sealed with its crush part 35 and in that state, the distal end of the electric wire W is inserted into the cap 30 whose front end 31 is crushed as shown in FIGS. 4(*a*) to 4(*d*). In addition, an arrow C in the drawing shows a crush operation of the front end 31 of the cap 30.

Figure 5:
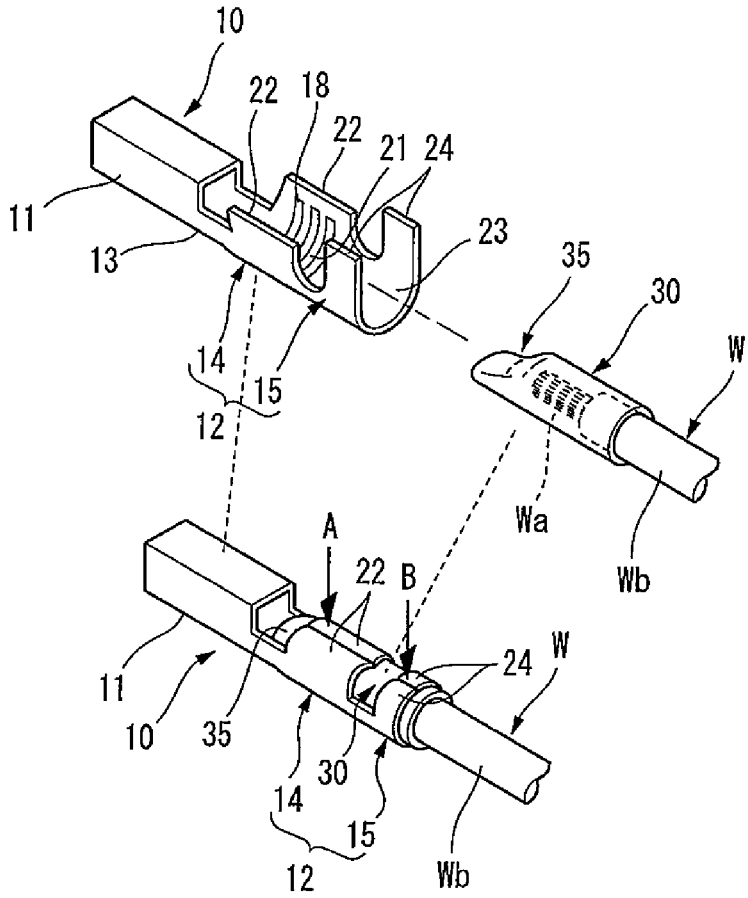
FIG. 5 is an explanatory diagram of the second and third embodiments of the invention, and is a completion perspective view and an exploded perspective view showing a relation among a crimping terminal, the electric wire and the cap.

Then, the distal end of the electric wire W to which the cap 30 obtained in steps shown in FIGS. 3(*a*) to 4(*d*) is already attached is placed on upper surfaces of base plate parts 21, 23 of a conductor crimping part 14 and a sheath crimping part 15 of an electric wire connection part 12 of a crimping terminal 10 shown in FIG. 5 and in that state, conductor crimping pieces 22 of the conductor crimping part 14 and sheath crimping pieces 24 of the sheath crimping part 15 are inwardly bent and are crimped so as to surround the distal end of the electric wire W through the cap 30 and thereby, the cap 30 and the conductor Wa of the electric wire are crushed and deformed to obtain the connection structure of each embodiment in which the crimping terminal 10 is connected to the electric wire W.

According to the connection structure of the crimping terminal 10 to the electric wire W configured thus, the front end 31 of the tubular cap 30 into which the distal end of the electric wire W is inserted is crushed and the front end 31 of the cap 30 is sealed with its crush part 35, so that while the tubular member whose both ends are opened without the need for squeezing work, cutting work, etc. is used as a cap material, hermeticity to the distal end of the electric wire W can be held and fear of electrolytic corrosion due to entrance of water from the outside can be solved. Therefore, cost can be made lower than a conventional connection structure using a cap manufactured by the squeezing work, the cutting work, etc. Also in this case, the front end 31 of the cap 30 is crushed in the stage before the electric wire crimping pieces (the conductor crimping pieces 22 and the sheath crimping pieces 24) are crimped, so that it is unnecessary to provide a crimp metal mold with an extra part for crushing the front end 31 of the cap 30, and complexity of the crimp metal mold can be avoided.

Fourth Embodiment

Figure 6A:
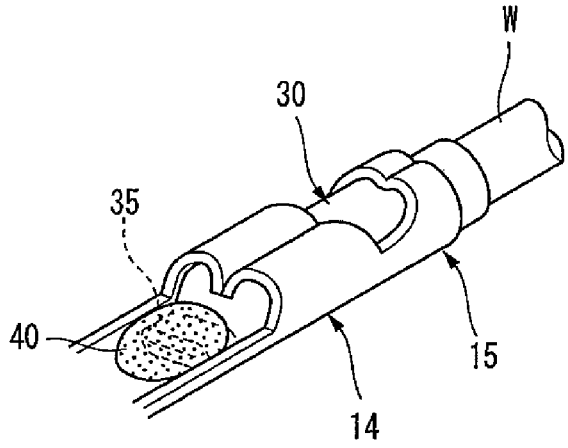
FIGS. 6(*a*) and 6(*b*) are explanatory diagrams of a fourth embodiment of the invention, and FIG. 6(*a*) is a perspective view showing a state in which a corrosion-proofing agent is applied so as to cover a crush part of the front end of a cap, and FIG. 6(*b*) is a sectional side view of FIG. 6(*a*).
Figure 6B:
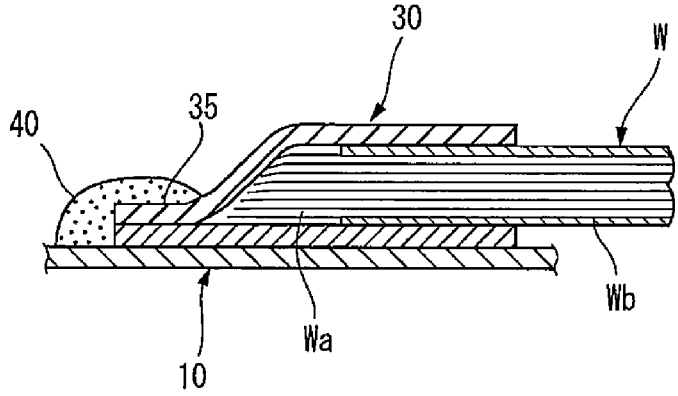
Figure 7A:
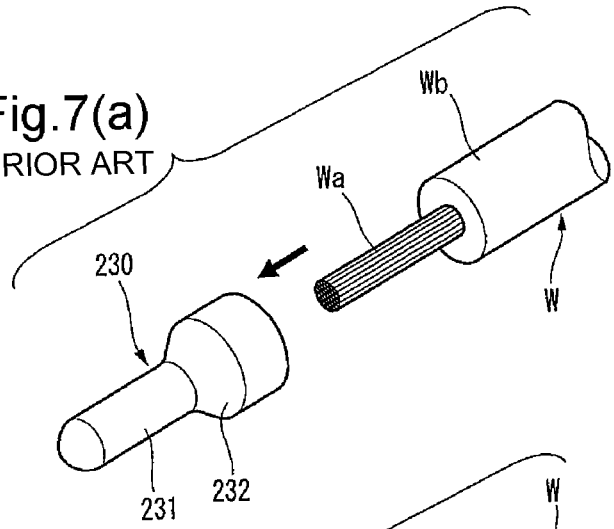
Fig.7(a) PRIOR ART
FIGS. 7(*a*) to 7(*c*) are explanatory diagrams of a conventional connection structure between a crimping terminal and an electric wire, and FIG. 7(*a*) is a perspective view showing a state in which the distal end of the electric wire attempts to be covered with a cap, and FIG. 7(*b*) is a perspective view showing a state in which the distal end of the electric wire covered with the cap attempts to be set in an electric wire connection part of the terminal, and FIG. 7(*c*) is a perspective view showing a state in which conductor crimping pieces of the electric wire connection part are crimped to the distal end of a conductor set in the electric wire connection part and the terminal is connected to the conductor.
Figure 7B:
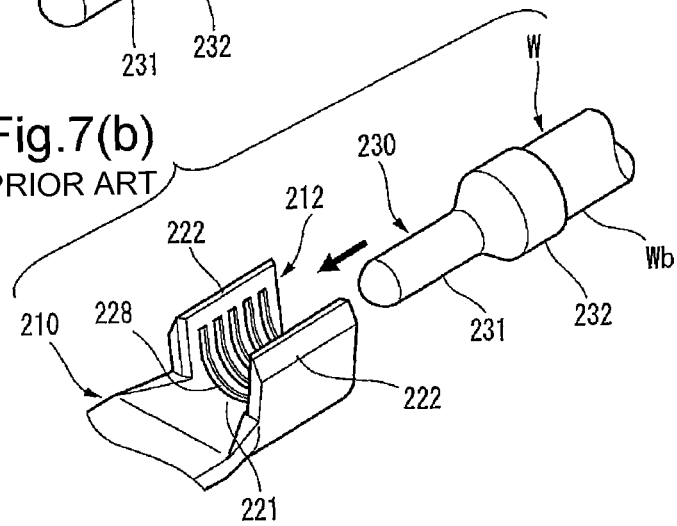
Fig.7(b) PRIOR ART
Figure 7C:
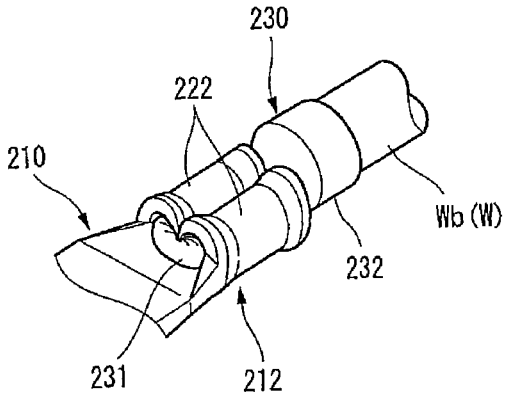
Fig.7(c) PRIOR ART

FIGS. 6(*a*) and 6(*b*) are explanatory diagrams of a fourth embodiment of the invention, and FIG. 6(*a*) is a perspective view showing a state in which a corrosion-proofing agent is applied so as to cover a crush part of the front end of a cap, and FIG. 6(*b*) is a sectional side view of FIG. 6(*a*).

In the fourth embodiment, a corrosion-proofing agent 40 is applied so as to cover a crush part 35 of a cap 30 in the stage in which a crimping terminal 10 is crimped to the distal end of an electric wire W through the cap 30. As the corrosion-proofing agent 40, for example, corrosion-proofing grease, a UV curable resin, etc. are given, and the corrosion-proofing agent could be applied with a brush or be dropped using a nozzle etc. When the corrosion-proofing agent 40 is applied to the crush part 35 of the cap 30, hermeticity to the distal end of the electric wire W can be held more surely.

Also, the invention may use any kind of electric wire, but can exert usefulness particularly when the crimping terminal is made of copper or copper alloy and the cap is made of copper or copper alloy and the electric wire is an aluminum electric wire.

In addition, the invention is not limited to the embodiments described above, and modifications, improvements, etc. can be made properly. Moreover, as long as the invention can be achieved, the number of components, materials, shapes, dimensions, arrangement places, etc. of each component in the embodiment described above are arbitrary and are not limited.

The invention has been described in detail with reference to the specific embodiments, but it is apparent to those skilled in the art that various changes or modifications can be made without departing from the spirit and scope of the invention. The present application is based on Japanese patent application (patent application No. 2010-085080) filed on Apr. 1, 2010, and the contents of the patent application are hereby incorporated by reference.

The invention claimed is:

1. A connection structure comprising:

a crimping terminal for connecting to an electric wire, the crimping terminal having:

an electric connection part for making connection to the other terminal in a front of the crimping terminal; and an electric wire connection part formed in substantially a U shape in cross-section view by having a base plate part, and a pair of electric wire crimping pieces which upwardly extends from both lateral edges of the base plate part and is crimped so as to obtain a state in which a distal end of the electric wire is brought into close contact with an upper surface of the base plate part by inwardly bending the electric wire crimping pieces so as to wrap the distal end of the electric wire to be connected in the back of the electric connection part; and a metallic tubular cap having a front end and a back end, and being attached to a conductor exposed by removing an insulating sheath of the distal end of the electric wire so as to cover a range to a portion of the insulating sheath of the electric wire, and wherein the electric wire crimping pieces are crimped so as to surround the cap, and prior to assembly, the front end and the back end of the metallic tubular cap are open, and after assembly, a front end of the cap is crushed forming a crushed part which closes and seals the front end of the cap.

2. The connection structure according to claim 1, wherein a corrosion-proofing agent is applied so as to cover the crush part of the cap.

3. The connection structure according to claim 1, wherein the cap is formed of a metal of the same kind as that of the terminal.

* * * * *